US005807077A

United States Patent [19]

Lamanna

[11] Patent Number: 5,807,077

[45] Date of Patent: Sep. 15, 1998

[54] FOOT OPERATED PUMP GUARD

[76] Inventor: Joe Lamanna, 6906 Pebble Creek Woods Dr., W. Bloomfield, Mich. 48322

[21] Appl. No.: 760,756

[22] Filed: Dec. 5, 1996

[51] Int. Cl.[6] ..... F04B 53/00

[52] U.S. Cl. ..... 417/234; 417/572; 417/903; 200/86.5; 200/333

[58] Field of Search ..... 417/234, 562, 417/903; 74/612, 560, 561, 563; 200/333, 338, 86.5

[56] References Cited

U.S. PATENT DOCUMENTS

| | | | |
|---|---|---|---|
| 1,738,483 | 12/1929 | Raymond . | |
| 1,817,409 | 8/1931 | Gusmus . | |
| 2,002,777 | 5/1935 | Johnson . | |
| 2,033,433 | 3/1936 | Leupold . | |
| 2,331,483 | 10/1943 | Lawman et al. . | |
| 2,333,792 | 11/1943 | Jackson . | |
| 2,341,547 | 2/1944 | Heineman . | |
| 2,355,947 | 8/1944 | Bondy et al. . | |
| 2,531,742 | 11/1950 | Pomykala . | |
| 2,619,846 | 12/1952 | Wales et al. . | |
| 2,959,826 | 11/1960 | Larsen et al. . | |
| 3,210,712 | 10/1965 | Goff . | |
| 3,241,707 | 3/1966 | Huntress et al. . | |
| 3,603,480 | 9/1971 | Irie et al. . | |
| 3,759,115 | 9/1973 | Dibonaventura et al. . | |
| 3,785,222 | 1/1974 | Dawson . | |
| 3,797,703 | 3/1974 | Yamawaki et al. . | |
| 3,916,722 | 11/1975 | Grobe . | |
| 3,948,408 | 4/1976 | Trout et al. . | |
| 4,394,552 | 7/1983 | Schlosser | 200/333 |
| 4,638,920 | 1/1987 | Goodhues, Jr. . | |
| 4,901,748 | 2/1990 | Shotmeyer . | |
| 5,027,849 | 7/1991 | Diesener . | |
| 5,166,513 | 11/1992 | Keenan et al. | 200/86.5 |
| 5,213,142 | 5/1993 | Koch et al. . | |
| 5,390,713 | 2/1995 | Fiech . | |
| 5,526,964 | 6/1996 | Moore et al. . | |

*Primary Examiner*—Charles G. Freay
*Attorney, Agent, or Firm*—Harness, Dickey & Pierce, P.L.C.

[57] ABSTRACT

A foot operated pump guard assembly for a portable pump includes a pair of upwardly extending support legs connected at their lower ends to a pump. A foot guard substantially surrounds an operator's foot and is pivotally connected to the upwardly extending support legs. Springs react against one another to cause the guard to self return upon removal of the operator's foot from the guard assembly. The guard has a built-in locking device and a carrying means to enhance in its transportability.

20 Claims, 3 Drawing Sheets

FOOT OPERATED PUMP GUARD

FIELD OF THE INVENTION

The present invention relates generally to a guard for a control device, and more particularly, to a self-centering foot operated guard for a foot operated portable pump.

BACKGROUND AND SUMMARY OF THE INVENTION

Foot operated switches and valve controls have long been used in industrial applications in connection with punch presses, forming machines, and the like. By using a foot-actuated control, the machine operator is afforded the convenience of having full use of both hands for positioning work pieces relative to the work station. Attaching a guard to machinery that utilizes foot operated switches and controls has become necessary in order to prevent inadvertent operation of the machinery by the operator.

When portable pumps are used in factory settings or even in garages, it has also become desirable to provide guards to prevent inadvertent operation of the machinery associated with these pumps. Portable pumps can weigh only a few pounds and can come in a variety of shapes and sizes including cylindrically-shaped air/hydraulic pumps and rectangular-shaped high efficiency air/hydraulic pumps for driving single-acting or double-acting rams connected to the pump. Some portable pumps have built-in foot actuated controls that use a release detent for convenient return of the ram of the cylinder. For safety reasons, it has been discovered that there is a need to provide a guard in the after-market and OEM for a foot-operated portable pump in order to prevent inadvertent activation of the pump.

Accordingly, it is an object of the present invention to provide a guard for a foot operated pump which overcomes the above-referenced problems, namely minimizes or eliminates inadvertent activation of a portable pump.

Another object is to provide a guard for a portable foot operated pump that has self-returning means for returning the guard to a central position when the pump is not being activated by an operator.

A further object is to provide a pump assembly having a foot operated guard with a built-in carrying means so that the entire pump and guard assembly can be picked up and easily transported.

Another object is to provide a guard assembly for a pump which is designed such that it is easy to operate and may be operated with a minimum amount of fatigue on the part of the operator.

An additional object is to provide a guard for a foot operated pump which is of rugged and durable construction so as to provide a trouble free service life, is simple in design and construction, and which can be retrofitted to an existing foot operated pump at a reasonable cost.

From the following specification taken in conjunction with the accompanying drawings and the pending claims, other objects, features, and advantages of the present invention will become apparent to those skilled in the art.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
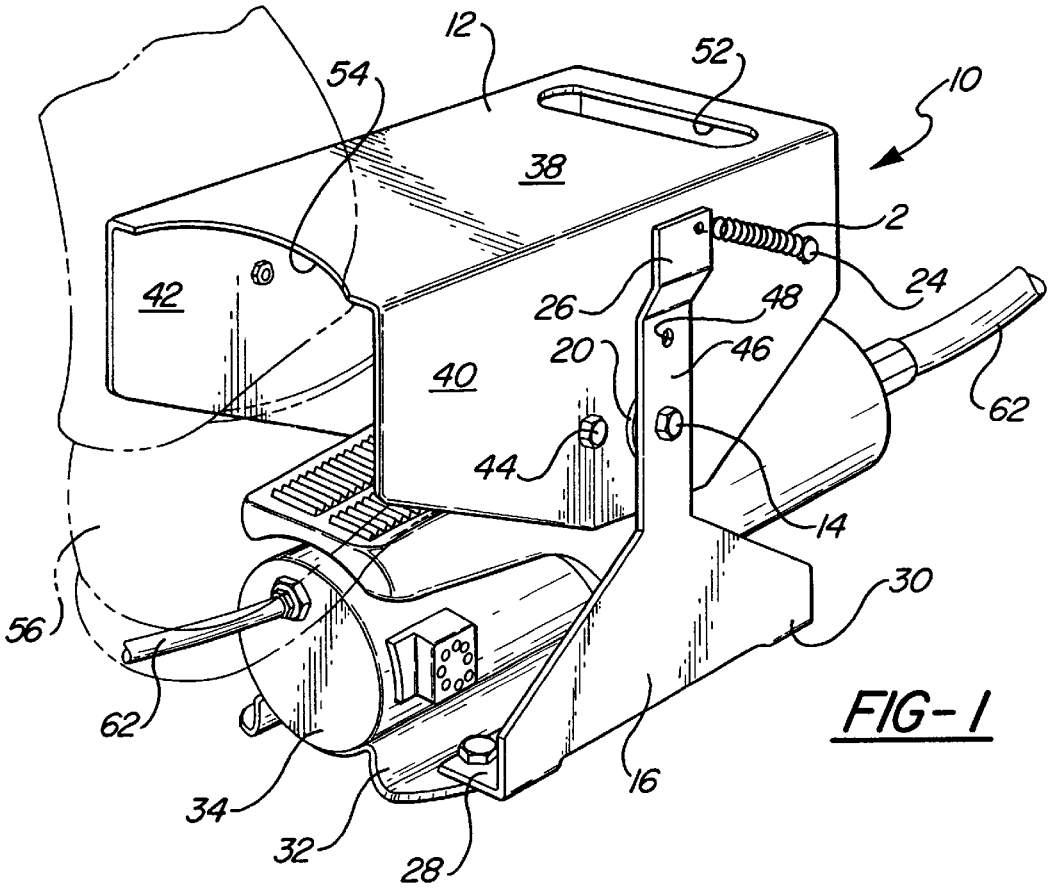
FIG. 1 is a perspective view of the preferred foot operated pump guard assembly.
Figure 2:
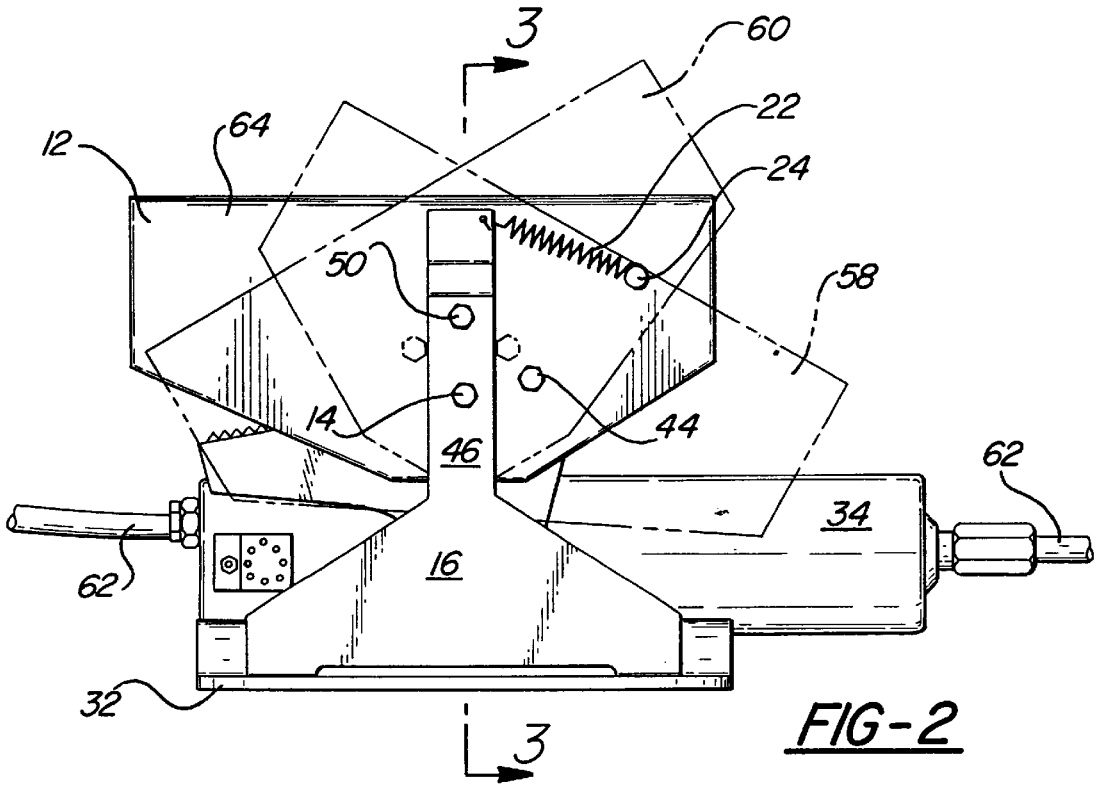
FIG. 2 is a side-elevational view of the foot operated pump guard assembly, with the guard depicted (in phantom) in two alternative positions.
Figure 3:
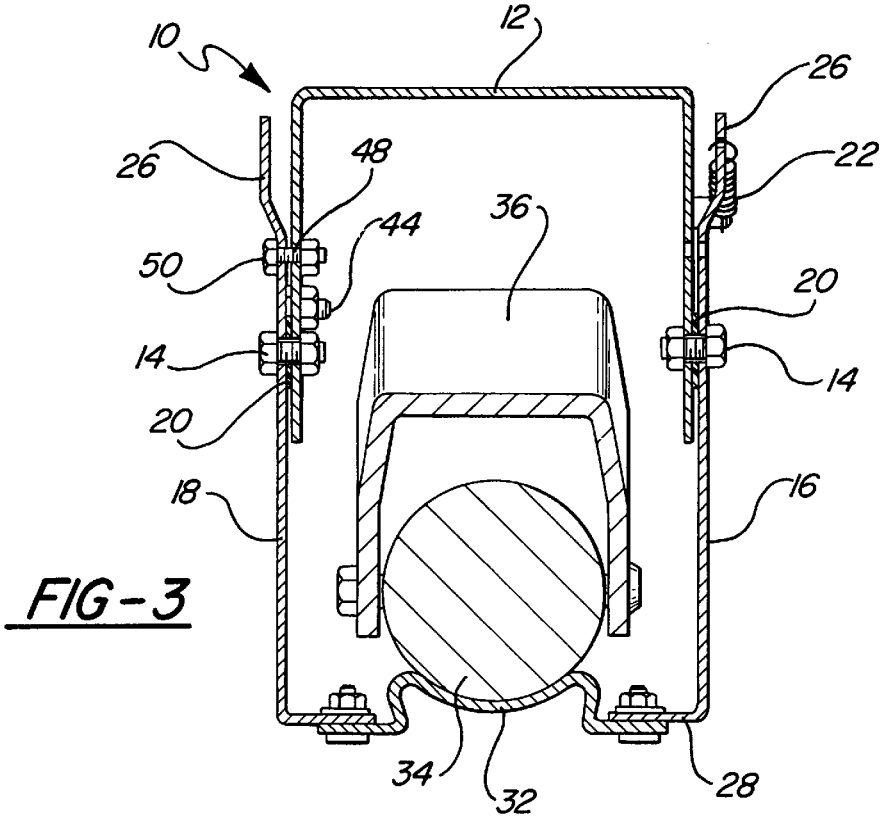
FIG. 3 is an end view of the foot operated pump guard assembly shown in FIG. 2 taken along line 3—3 and illustrates the pump and pedal in relation to the guard mechanism.
Figure 4:
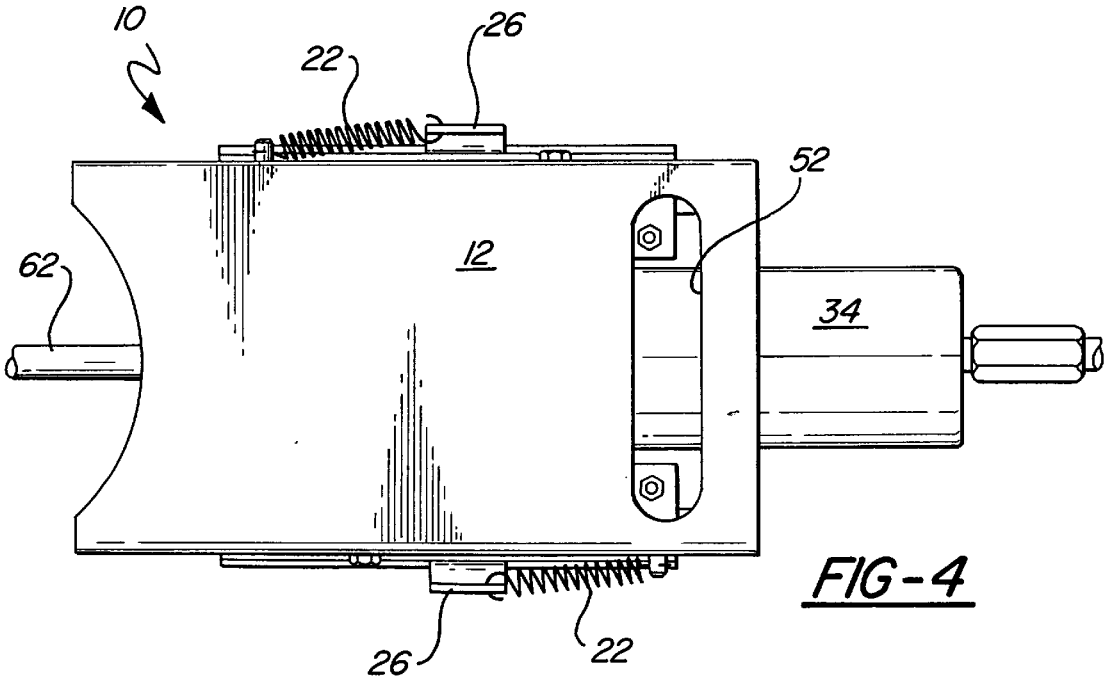
FIG. 4 is a top view of the foot operated pump guard assembly illustrating the positioning of the spring members.

As illustrated in FIGS. 1–4, a novel foot operated pump guard assembly 10 is illustrated which includes a guard 12 that is pivotally connected by a bolt or pivot member 14 to a pair of upwardly extending support legs 16 and 18. A pair of bushings 20 preferably made of low friction material, such as nylon, are disposed between the support legs 16 and 18 and the foot guard 12. A spring 22 is connected at one end to a fastener 24 which is in turn secured to the foot guard 12. The other end of the spring 22 is connected to an offset portion 26 of the leg 16. Legs 16 and 18 are inverted symmetrically Y-shaped members and the guard 12 and legs 16 and 18 are preferably made of metal such as aluminum. Because legs 16 and 18 are identical, only a discussion of leg 16 will be presented.

The lower portion of support leg 16 has a pair of perpendicularly extending flanges 28 and 30 that are secured to a cradle 32 which is in turn secured to an air or hydraulic pump 34. The cradle 32 is configured to fit the shape of the cylindrically-shaped pump 34 and acts as a base to which the pump is anchored to by conventional means. Conventional fastening members are used to secure the support legs 16 to the cradle 32 at a plurality of locations. A foot pedal 36 is pivotally connected to the pump 34.

The foot guard 12 has a substantially planer upper surface 38 and a pair of symmetrically-shaped perpendicularly-extending side sections 40 and 42. Each side section has a stop 44 that is operable to engage an elongated section 46 of each support leg when the guard 12 is rotated to its extreme position. The elongated section 46 has a clearance hole 48 that is operable to receive a pin or fastener 50 (FIG. 3) that acts as a locking device once inserted through hole 48 and a corresponding hole 48' in the guard 12. The locking device prevents the guard from rotating thus not stressing the springs 22 when the foot guard assembly 10 is being hand-carried.

The planer surface 38 of the guard 12 also has an oval-shaped slot 52 for allowing an operator to easily insert his/her hand for transporting the guard assembly 10. A concave recess 54 allows for easy access of the operator's foot 56 (shown in phantom) to the pedal 36. Suitable lines 62 deliver air or hydraulic fluid to and from the pump 32 and can be easily disconnected therefrom.

The foot operated pump guard is operated by inserting a foot 56 within the recess end of the assembly wherein the pedal 36 can be maneuvered to a variety of positions including extreme positions 58 and 60 (shown in phantom).

The guard 12 is prevented from traveling too far by stops 44. When the operator removes his/her foot 56 from the guard assembly 10, the tension of springs 22 cause the guard 12 to automatically return itself to a central position 64 (shown in FIG. 1). The pedal 36 concurrently returns to a deactivated position.

Figure 5:
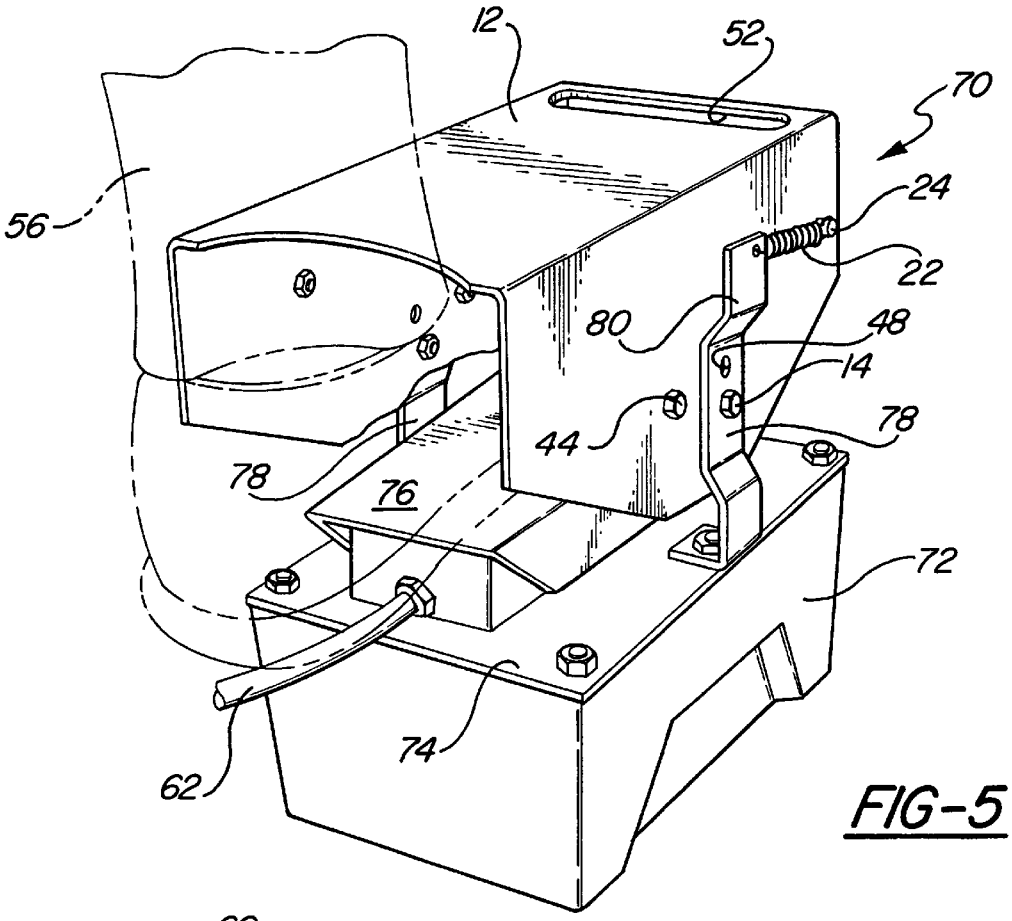
FIG. 5 is an alternative embodiment to the FIG. 1 foot operated pump guard assembly showing a different style pump and a different mounting arrangement for the guard.
Figure 6:
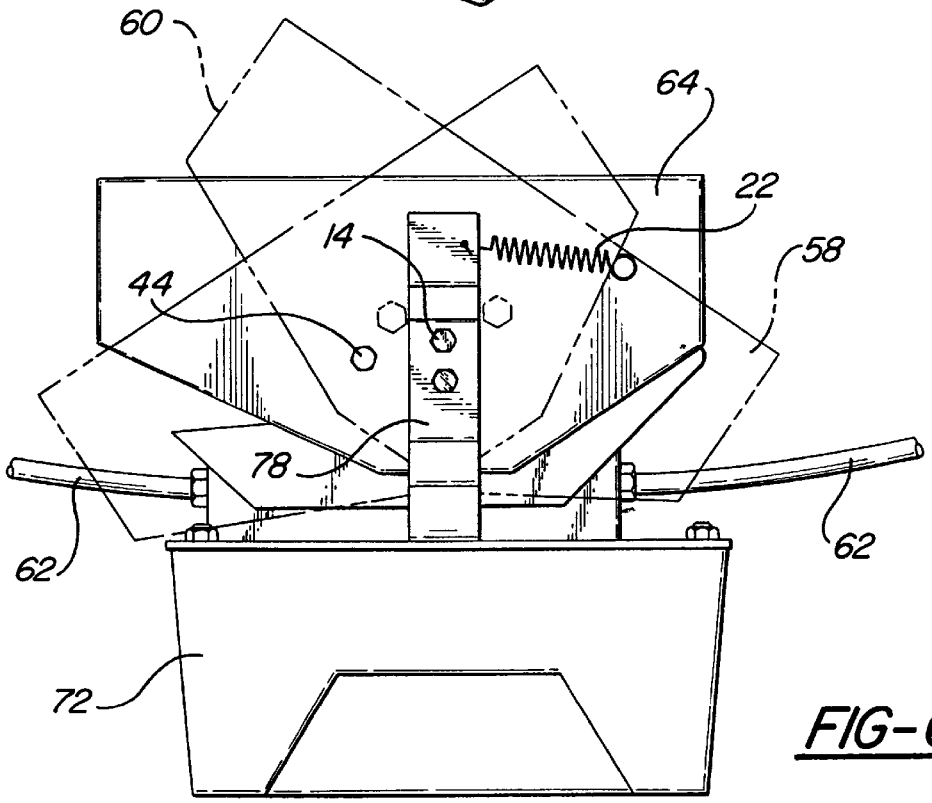
FIG. 6 is a side-elevational view of the FIG. 5 foot operated pump guard assembly showing the guard (in phantom) in two opposite positions.

FIGS. 5 and 6 illustrate an alternative foot operated pump guard assembly 70 which utilizes the same guard 12 as the previously mentioned assembly. Where possible, like numbers will be used to describe the same features. This guard assembly employs a rectangular-shaped air/hydraulic pump 72 that has a substantially flat top surface 74 and a foot pedal 76 pivotally connected thereto. Fluid/air lines 62 supply air or fluid to and from the pump 72. A pair of upper leg support brackets 78 are used instead of the previously mentioned support legs 16 and 18 for pivotally supporting the guard 12. Each bracket 78 is secured to the top surface 74 of the pump 72 by conventional fastening means. An offset 80 provides clearance for spring 22 to be connected to pin 24. The springs 22 (only one shown) allow the pedal to return lo a centered position once the foot 56 is removed from the pump 72.

A pivot member 14 allows the guard 12 to pivot relative to the support brackets 78. A stop 44 prevents the guard 12 from pivoting too far. The guard 12 is positionable along a variety of locations of which include extreme positions 58 and 60. To carry the guard assembly 70 which includes its connected pump 72, pin 14 is inserted in hole 48 as described before thus locking the assembly and temporarily preventing it from pivoting. The oval-shaped slotted handle 52 is of sufficient size to receive a hand. This has been found to be most useful during transporting the assembly 70. To use the pump guard assembly 70, the pin 14 is removed and lines 62 are reconnected.

The foregoing discussion discloses and describes merely exemplary embodiments of the present invention. One skilled in the art will readily recognize from such discussion and from the accompanying drawings and claims that various changes, modifications, and variations can be made therein without departing from the spirit and scope of the invention as defined in the following claims:

What is claimed is:

1. A guard assembly for a portable foot operated pump comprising:

a first upwardly extending bracket member having a spring receiving portion on one end and a flange that is operable to be secured to a pump at another end;

a second upwardly extending bracket member spaced apart from the first bracket member;

a guard pivotally connected to said first and second bracket members, the guard having a substantially planar surface and pair of flanges extending downwardly therefrom, the planar surface having handle means and a recess for receiving a foot;

connecting members for pivotally connecting the guard to the bracket members;

bushings disposed between the guard and the bracket members;

a spring connected to the guard and one of the bracket members for biasing the guard in a first position; and a stop connected to the guard for preventing the guard from rotating to an undesirable position.

2. The guard assembly as claimed in claim 1, wherein the second upwardly extending bracket member has a spring receiving portion on one end and a flange that is operable to be secured to a pump at another end.

3. The guard assembly as claimed in claim 1, further comprising a pin that is operable to lock the guard and a bracket member relative to one another.

4. The guard assembly as claimed in claim 1, wherein the bushings are made of nylon.

5. The guard assembly as claimed in claim 1, further comprising a fluid pump secured to the bracket members.

6. The guard assembly as claimed in claim 1, further comprising a pedal pivotally connected to the fluid pump.

7. A portable foot operated pump having a guard assembly comprising:

a portable pump;

support legs extending upwardly from the portable pump;

a guard with a main section and side sections extending downwardly therefrom towards the support legs;

a pivot member connecting the guard to the support legs; and a spring member connected to the support legs and to the guard, the spring member operable to bias the guard to a desired position.

8. The portable foot operated pump as claimed in claim 7, wherein the pump has flanges extending outwardly therefrom for engaging the support legs.

9. The portable foot operated pump as claimed in claim 7, wherein the pump has a pedal pivotally connected thereto.

10. The portable foot operated pump as claimed in claim 7, wherein each support leg has a substantially vertical planar surface, a mounting flange extending normal thereto and an offset portion extending from the planar surface.

11. The portable foot operated pump as claimed in claim 7, further comprising a locking device insertable through the guard and the support legs for preventing the guard from pivoting relative to the support legs during a locking mode.

12. The portable foot operated pump as claimed in claim 7, further comprising a bushing located between the support legs and the guard.

13. The portable foot operated pump as claimed in claim 7, further comprising a stop member secured to each side section of the guard for limiting movement of the guard.

14. The portable foot operated pump as claimed in claim 7, further comprising another spring member connected to one of the other support legs and to the guard.

15. The portable foot operated pump as claimed in claim 7, wherein the main section of the guard has an oval-shaped handle.

16. The portable foot operated pump as claimed in claim 7, wherein the main section of the guard has a concave recess.

17. The portable foot operated pump as claimed in claim 7, wherein the pivot member consist of a self-locking nut and a bolt.

18. A guard assembly for a control device comprising:

a U-shaped guard substantially surrounding a switch;

a locking device for aiding transport of the guard assembly;

a support member for pivotally supporting the U-shaped guard; and a biasing member connected to the guard and support member for returning the U-shaped guard to a predetermined position.

19. The guard assembly as claimed in claim 18, further comprising a stop fixed to the guard for limiting pivotal rotation of the guard relative to the support member.

20. The guard assembly as claimed in claim 18, wherein the guard has a handle.

* * * * *